United States Patent [19]

Larsen

[11] Patent Number: 4,887,734

[45] Date of Patent: Dec. 19, 1989

[54] METHOD AND APPARATUS FOR OPENING AND RECLOSING BEVERAGE CANS

[76] Inventor: Jeffrey A. Larsen, Rte. 3, Box 212, Neillsville, Wis. 54456

[21] Appl. No.: 307,093

[22] Filed: Feb. 6, 1989

Related U.S. Application Data

[63] Continuation-in-part of Ser. No. 180,531, Apr. 12, 1988, abandoned.

[51] Int. Cl.[4] ..... B67B 7/24

[52] U.S. Cl. ..... 220/306; 220/278; 220/260; 30/450; 30/411; 7/152

[58] Field of Search ..... 220/306, 278, 260; 7/151, 152; 81/3.09, 3.47, 3.57, 3.48, 3.55; 30/411, 443, 445, 446, 407, 450

[56] References Cited

U.S. PATENT DOCUMENTS

| | | | |
|---|---|---|---|
| 1,296,447 | 3/1919 | Whitney | 220/278 |
| 1,660,296 | 2/1928 | Hansen | 220/278 |
| 1,826,838 | 10/1931 | Stump | 220/278 |
| 2,649,989 | 8/1953 | Urbano . | |
| 3,071,286 | 11/1963 | Valvano . | |
| 3,221,918 | 12/1965 | Callegari . | |
| 3,438,542 | 4/1969 | Feld . | |
| 3,650,432 | 3/1972 | Easton et al. . | |
| 3,670,920 | 6/1972 | Rohrlick . | |
| 3,705,666 | 12/1972 | Nelson et al. . | |
| 3,984,026 | 10/1976 | Shoup . | |
| 4,103,802 | 8/1978 | Piltz et al. . | |
| 4,103,804 | 8/1978 | Fournier et al. . | |
| 4,136,448 | 1/1979 | Fournier . | |
| 4,332,282 | 6/1982 | Strange . | |
| 4,561,560 | 12/1985 | Lyon | 220/278 |
| 4,631,769 | 12/1986 | White . | |

*Primary Examiner*—George E. Lowrance
*Assistant Examiner*—Gilbert W. Reece
*Attorney, Agent, or Firm*—Faegre & Benson

[57] ABSTRACT

Apparatus for opening and reclosing beverage cans in a first embodiment includes a tool having piercing and forming portions for opening an aperture in and shaping a flap depending from an end wall of a beverage can spaced a predetermined distance spaced substantially away from the cylindrical side wall of the can sufficient to permit the forming portion to displace the flap resulting from the piercing closely against the interior surface of the end wall of the can such that the interior surface surrounding the periphery of the aperture thus formed is substantially planar, and in a second embodiment includes a tool having a cylindrical piercing portion, the apparatus further including a plug carried on the tool for reclosing and sealing the aperture in the can.

6 Claims, 3 Drawing Sheets

METHOD AND APPARATUS FOR OPENING AND RECLOSING BEVERAGE CANS

CROSS REFERENCE TO RELATED APPLICATION

This is a continuation-in-part of the co-pending patent application for a METHOD AND APPARATUS FOR OPENING AND RECLOSING BEVERAGE CANS, Ser. No. 180,531, filed Apr. 12, 1988, abandoned.

BACKGROUND OF THE INVENTION

This invention relates to apparatus and method for opening and reclosing beverage cans. In the past, can openers have been available to pierce an end wall of beverage cans. Such prior art devices typically have formed an aperture closely adjacent the cylindrical side wall of such cans with a flap depending from the end wall relatively closely adjacent the side wall. The aperture thus formed has not been readily reclosable, because of the three dimensional nature of the aperture, which included a boundary shared with the depending flap. Furthermore, the close spacing between the flap and cylindrical side wall interfered with further displacement of the flap sufficiently to prevent formation of a readily reclosable aperture.

SUMMARY OF THE INVENTION

The present invention overcomes the disadvantages of the prior art by providing an aperture creating and forming tool which carries reclosing or resealing plugs thereon.

In one embodiment, the aperture forming tool of the present invention has a piercing portion to open an aperture in an end wall and a separate bending portion to displace a flap created by the piercing portion against the interior of the end wall. This tool preferably forms a triangular aperture in an end wall displaced a predetermined distance and substantially away from the cylindrical side wall of a beverage can and results in an aperture having a triangular interior edge surrounded by a substantially planar surface. This permits the use of a simple and efficient reclosing and resealing plug having a triangular projection to engage the peripheral edge of the aperture to reclose the can.

In another embodiment, the aperture forming tool of the present invention has a piercing portion to open a generally circular aperture in an end wall and simultaneously displace the flap created by the piercing away from the interior of the end wall sufficient to permit insertion of a threaded resealing plus adapted to mate with and reclose the circular aperture formed in the end wall.

DETAILED DESCRIPTION

Figure 1:
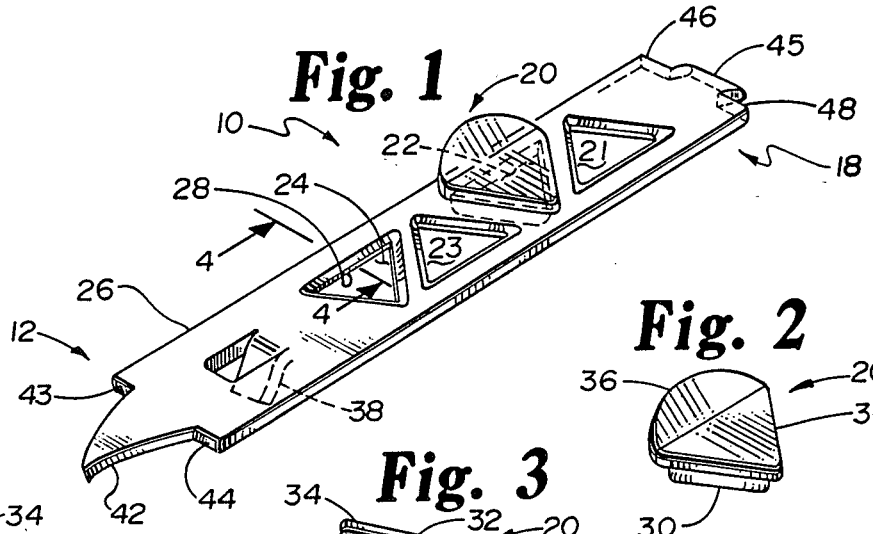
FIG. 1 is a perspective view of a first embodiment of the beverage can opening and forming tool, carrying a reclosing plug in a storage aperture.
Figure 2:
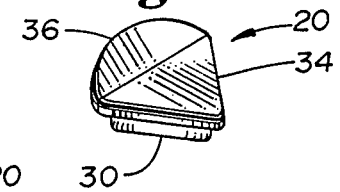
FIG. 2 is a top perspective view of a first embodiment of a reclosing plug.

Referring to FIG. 1, a beverage can opening and reclosing tool 10 can be seen. Tool 10 has a first means or end portion 12 for piercing an end wall 14 of a cylindrical beverage can 16. Tool 10 also has a second means or end portion 18 for forming a planar peripheral interior surface at the edge of the end wall aperture 50 as will be described in more detail hereinafter. Tool 10 also carries an aperture reclosing or resealing plug 20 in a storage aperture 22 in a long and generally planar body 26. Additional storage apertures 21, 23 and 24 are provided in tool 10 for storage of additional plugs (not shown). It is to be understood that the storage apertures have substantially the same dimensions as the end wall aperture 50.

Figure 4:
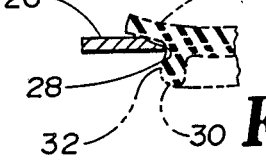
FIG. 4 is a fragmentary section view taken along line 4—4 of FIG. 1.
Figure 3:
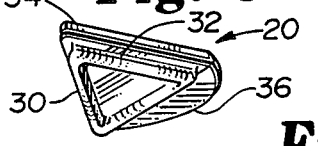
FIG. 3 is a bottom perspective view of the plug of FIG. 2.

Referring more particularly to FIG. 4, body 26 of tool 10 preferably has a coined edge 28 about the periphery of aperture 24. It is to be understood that the other storage apertures have a similar characteristic. Plug 20 has a deformable projection 30 adapted to mate with aperture 24 and which extends past the aperture and has a distal portion 31 which is slightly larger than the peripheral edge 28 in order to retain plug 20 in aperture 24 or 22. Projection 30 also has an undercut region proximal portion 32 to mate with the peripheral edge 28 of aperture 24. Region 32 may correspond to and be the same size as (i.e., congruent to) the corresponding peripheral edge of aperture 50 or alternatively may be slightly larger than the mating aperture to provide for reliable sealing. Plug 20 further has a rim portion 34 substantially larger than aperture 50 to prevent plug 20 from passing entirely through aperture 24. Plug 20 further has a tab or lip 36 on rim 34 useful for grasping plug 20 to remove it from an aperture 24.

Figure 5:
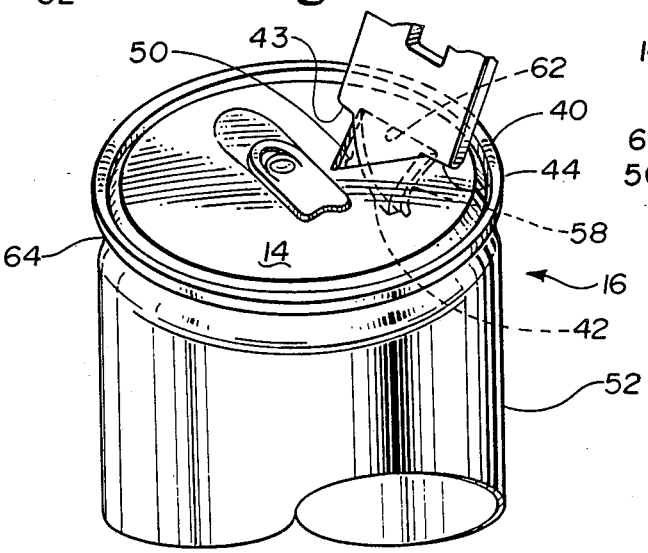
FIG. 5 is a fragmentary perspective view illustrating piercing of the end wall of the beverage can with the tool of FIG. 1.
Figure 6:
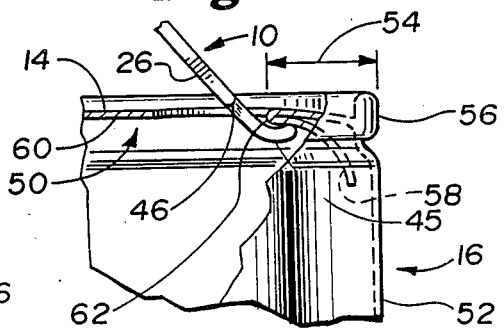
FIG. 6 is a fragmentary side elevational view, partly in section, of a can illustrating the operation of the flap forming portion of the tool of FIG. 1.

Referring now again to FIG. 1, tool 10 further has a pry hook 38 adapted to engage rim 40 of can 16. Tool 10 has a relatively sharp projection or piercing portion 42 formed as part of end portion 12. Piercing portion or piercing tool 42 is located intermediate a pair of piercing tool shoulders 43, 44 in end portion 12 and has a maximum width 49. Portion 42 preferably projects out of the plane of body 26. Tool 10 still further has a curved blunt projection or bending tool 45 intermediate a pair of bending tool shoulders 46, 48 in second end portion 18. Body 26 is thus seen to be common to both the piercing tool 42 and the bending tool 45. First and second end portions 12, 18 are thus seen to be preferably each located at an opposite end of tool 10. Referring now more particularly to FIG. 5, pry hook 38 is adapted to be placed against rim 40 of can 16 and piercing portion 42 is adapted to be urged against end wall 14, (by leverage afforded by pry hook 38 acting against rim 40) to pierce or open an aperture 50 in end wall 14 and resulting in a flap 58 depending form an edge 62 of aperture 50 in end wall 14 and having a maximum width equal to width 49 of piercing tool 42. It is to be understood that pry hook 38 is spaced from the sharp projection or piercing tool 42 to position aperture 50 a predetermined distance 54 substantially away from cylindrical side wall 52 and any other structure of can 16 which would interfere with displacement of flap 58 against the interior surface 60 of end wall 14 adjacent aperture 50. Shoulders 43, 44 serve as a stop to limit the penetration of piercing tool 42 and thus cooperate with hook 38 to set predetermined distance 54 from peripheral edge 62 of aperture 50 to rim 40. As shoulders 43, 44 contact end wall 14, hook 38 is adapted to disengage from can 16 thus permitting piercing tool 42 to rotate about shoulders 43, 44 in contact with end wall 14 to partially displace flap 58 away from aperture 50 and towards an interior surface 60 of end wall 14. Piercing tool 14 is then withdrawn from aperture 50 and curved projection 44 is inserted into aperture 50. Curved projection 45 has a width 47 less than the maximum width 49 of flap 58 and second end portion 18 which includes projection 45 and shoulders 46, 48 has an overall width greater than a maximum width of aperture 50 so that tool 50 is supported on shoulders 46, 48 when projection 45 is inserted into aperture 50. Tool 10 is further adapted to be pivoted about shoulder 46, 48 while projection 44 is in contact with a flap 58 depending from end wall 14 as a result of piercing tool penetrating end wall 14. As shown in FIG. 6, distance 54 is set to be sufficient to permit projection 45 to form flap 58 closely against the interior surface 60 of end wall 14 at the peripheral edge 62 of aperture 50 to result in a region adjacent peripheral edge 62 being substantially planar interior of can 16. Although FIG. 6 shows body 26 of tool 10 elevated when flap 58 is closely formed against surface 60, it has been found preferable to have body 26 of tool 10 come to rest against rim 40 in a region 64 diametrically opposite aperture 50 when flap 58 is fully displaced against interior surface 60 of end wall 14, thus providing a positive stop or gauge for the shaping of flap 58.

Figure 7:
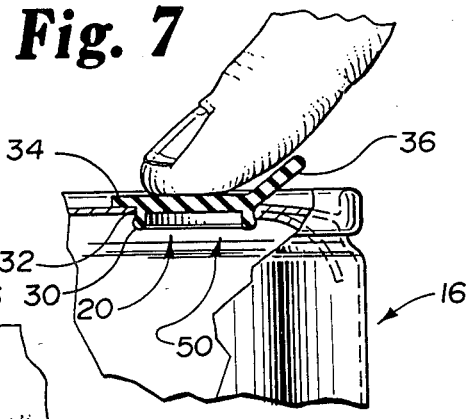
FIG. 7 is a view similar to FIG. 6 showing the installation of the reclosing plug of FIGS. 2 and 3.

After flap 58 is formed as shown in FIG. 6, tool 10 may be withdrawn, and plug 20 may be inserted in aperture 50 as shown in FIG. 7. It is to be understood that plug 20 is preferably formed of a resilient material such as rubber or plastic such that projection 30 may be deformed to insert plug 20 into aperture 50. Because flap 58 has been formed to provide a substantially planar region adjacent peripheral edge 62 of aperture 50, plug 50 will seal can 16 under normal circumstances.

Figure 8:
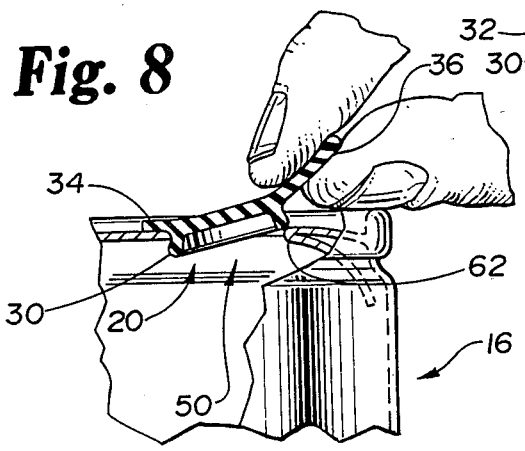
FIG. 8 is a view similar to FIGS. 6 and 7 showing the removal of the plug of FIGS. 2 and 3.

To remove plug 50, tab 36 is grasped as shown in FIG. 8 and plug 20 is withdrawn from aperture 50.

The method of opening and reclosing a canned beverage is, first, to engage pry hook 38 with rim 40. Tool 10 is then urged to open end wall 14 of beverage can 16 with piercing tool 42 in a region positioned a predetermined distance 54 which is substantially spaced away from cylindrical side wall 52 of can 16 such that aperture 50 is formed in end wall 14 having flap 58 depending from edge 62 of aperture 50 and into the interior 66 of can 16. The opening of aperture 50 is terminated when piercing tool shoulders 43, 44 contact end wall 14. Pry hook 38 is then released or disengaged from rim 40 and piercing tool 42 is rotated about shoulders 43, 44 in contact with end wall 14 to partially displace flap 58 away from aperture 50. Next, flap 58 is further displaced with bending tool 45 to come to rest against interior surface 60 of end wall 14 in a region adjacent edge 62 of aperture 50 resulting in a generally planar interior surface peripheral to aperture 50. During this step bending tool 45 is pivoted about bending tool shoulders 46, 48 in abutment with end wall 14. Finally, aperture 50 may be reclosed by inserting resilient plug 20 having deformable projection 30 adapted to mate with and seal against the edge of aperture 50, as shown in FIG. 7.

Figure 9:
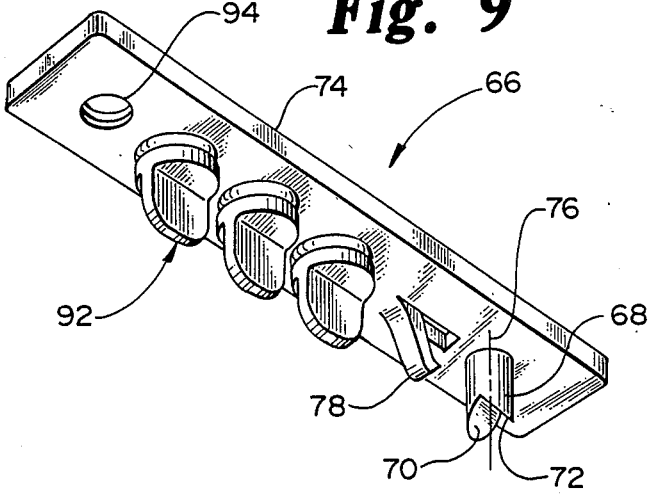
FIG. 9 is a perspective view of a second embodiment of the beverage can opening and forming tool.
Figure 12:
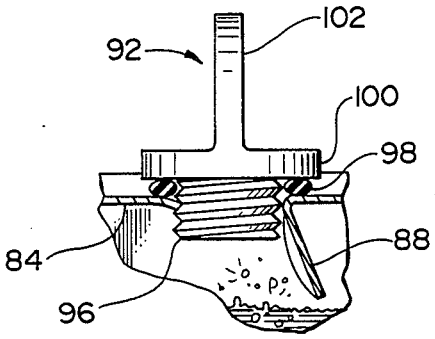
FIG. 12 is a detailed view of a plug assembly of this embodiment screwed tightly into a punched hole in the can top.
Figure 10:
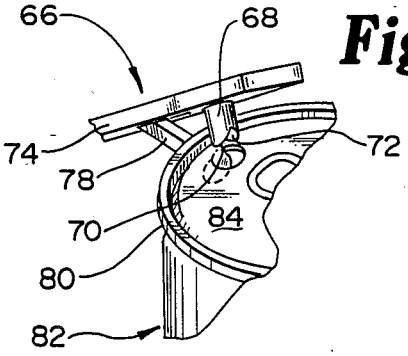
FIG. 10 is a fragmentary perspective view illustrating piercing of the end wall of a beverage can with the tool of FIG. 9.
Figure 11:
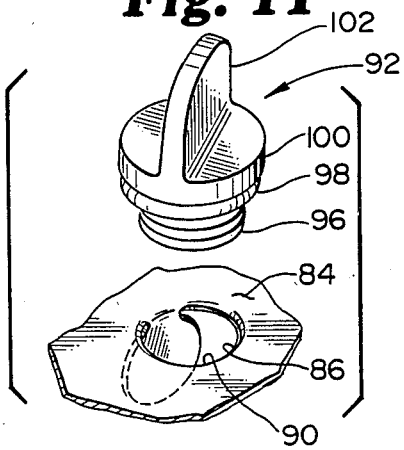
FIG. 11 is an exploded pictorial view of a plug assembly for the aperture formed by the tool of FIG. 9 suspended over a punched hole in a fragmentary view of a can top.

Referring now to FIGS. 9 and 10, an alternative embodiment of an aperture forming and closing apparatus 66 may be seen. Apparatus 66 preferably includes a cylindrical punch member 68 having cutting ears 70, 72. Punch 68 preferably projects perpendicular to a main body portion 74 of apparatus 66 along a principal axis 76 of apparatus 66. Apparatus 66 further preferably includes a hook 78 adapted to mate with a rim 80 of a can 82.

In operation, hook 78 engages rim 80 and ears 70, 72 of punch 68 are urged against end wall 84 of can 82 by rotating apparatus 66 about hook 78. Punch 68 and hook 78 are preferably dimensioned to cause an aperture 86 to be formed in end wall 84, with a depending flap 88 remaining attached to a periphery 90 of aperture 86. One or more reclosing plugs 92 may be stored in corresponding apertures 94 in apparatus 66. Reclosing plug 92 preferably has a threaded shaft portion 96, a seal portion 98, a flange portion 100, and a blade portion 102. Seal portion may be integrally formed with plug 98, provided plug 98 is formed of appropriate material, such as a resilient plastic or elastimer. Alternatively, seal portion 98 may be a separate member, such as an o-ring, carried by plug 92.

To reclose aperture 86, plug 92 is preferably threaded into aperture 86 such that threaded portion 96 engages periphery 90. Plug 92 is tightened until seal 98 engages and seals against end wall 84.

Figure 14:
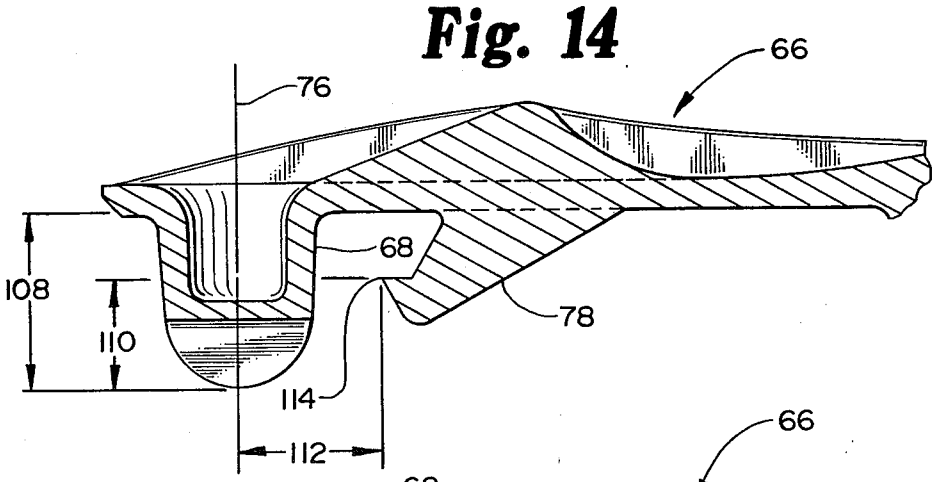
FIG. 14 is a fragmentary partial section view along line 14—14 of FIG. 13.
Figure 15:
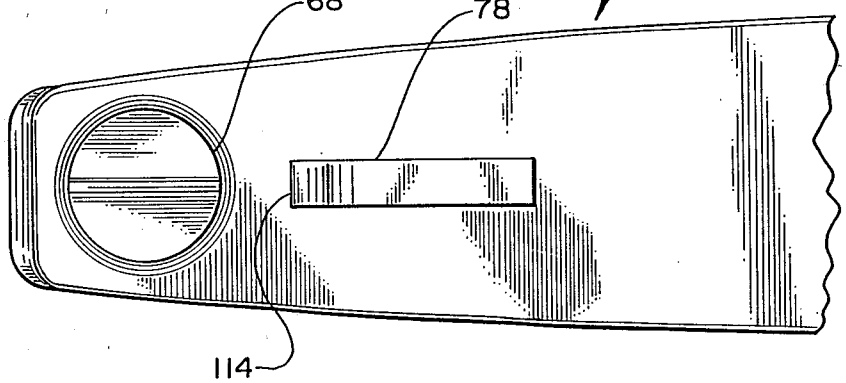
FIG. 15 is a fragmentary bottom view of the embodiment of FIGS. 13 and 14.
Figure 13:
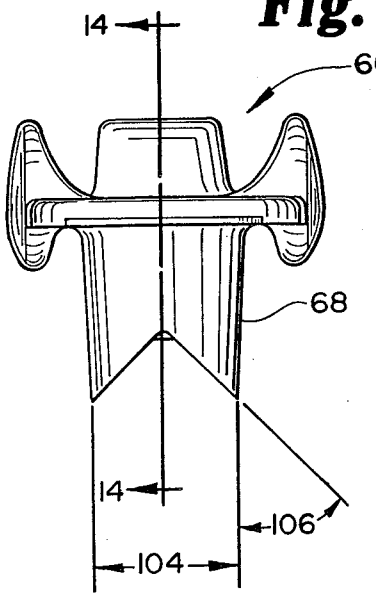
FIG. 13 is an end view of a still further alternative embodiment similar to the embodiment of FIG. 9.

Referring now to FIGS. 13–15, it has been found that a preferred dimension 104 for the diameter of punch 68 is $0.47+0.03-0.00$ inches. A preferred angle 106 for ears 70, 72 is 45°. A preferred height dimension 108 for punch 68 is preferably $0.55\times0.00-0.03$ inches. A preferred dimension 110 is preferably $0.35\pm0.03$ inches for the distance from the tip of the punch 68 to the operating plane of the hook 78. Dimension 112 is preferably $0.48\pm0.03$ inches from the center line or principal axis 76 of punch 68 to the tip 114 of hook 78. In this embodiment, cast aluminum is a preferred material to form apparatus 66.

The invention is not to be taken as limited to all of the details thereof as modifications and variations thereof may be made without departing from the spirit or scope of the invention. For example, although the predetermined distance 54 is shown as measured from the datum of outer surface 56 of rim 40, another datum or reference surface on can 16 may be chosen. As a still further example, piercing portion 42 may have alternate geometry with a corresponding change in the shape of projection 30, (for example, a geometry having concave or convex sides) if desired. Finally, while the curved projection 45 is shown projecting out of the plane of body 26 on the same side as the piercing portion 42, it has been found desirable to have projection 45 extend out of the plane of body 26 on the opposite side from portion 42 to avoid having a sharp projection on the side of tool to which pressure is applied while using curved projection 45.

What is claimed is:

1. Apparatus for opening and reclosing a beverage can comprising:

(a) an aperture piercing tool having:

(i) a generally enongate body, (ii) cylindrical punch means extending generally perpendicularly away from and located at an end of the elongate body, and (iii) a hook positioned a predetermined distance away from the punch means and projecting from the body towards the punch means such that the hook is adapted to engage a rim of a beverage can and that punch means is adapted for forming a generally circular aperture in an end wall of the beverage can as the tool is rotated about the rim by the hook; and (b) an aperture reclosing plug having:

(i) threaded shaft portion, (ii) a flange portion, and (iii) a seal portion, and wherein the tool further comprises (iv) a storage aperture for storing the aperture reclosing plug.

2. The apparatus of claim 1 wherein the punch means further comprises at least one cutting ear at a distal end thereof.

3. The apparatus of claim 1 wherein the punch means further comprises a plurality of cutting ears at a distal end thereof.

4. The apparatus of claim 1 wherein the tool is formed of metal.

5. The apparatus of claim 1 wherein the tool is formed of aluminum.

6. The apparatus of claim 1 wherein at least the seal portion of the plug is formed of a resilient material.

* * * * *